US005169450A

United States Patent [19]

Opad et al.

[11] Patent Number: 5,169,450

[45] Date of Patent: Dec. 8, 1992

[54] CORONA TREATMENT ROLLER ELECTRODE

[75] Inventors: Jeffrey S. Opad, Buffalo Grove, Ill.; James R. Carlson, Racine, Wis.

[73] Assignee: American Roller Company, Union Grove, Wis.

[21] Appl. No.: 687,350

[22] Filed: Apr. 18, 1991

[51] Int. Cl.[5] ..... B05C 17/02

[52] U.S. Cl. ..... 118/621; 427/535; 29/123

[58] Field of Search ..... 118/621; 427/39; 29/123, 130, 132; 219/244; 156/272.6, 380.3; 264/22; 425/174

[56] References Cited

U.S. PATENT DOCUMENTS

| | | | |
|---|---|---|---|
| 3,566,497 | 3/1971 | Mamlen | 29/123 |
| 3,935,517 | 1/1976 | O'Brien | 317/262 |
| 4,239,973 | 2/1980 | Kolbe et al. | 250/531 |
| 4,649,097 | 3/1987 | Tsukada et al. | 430/270 |
| 4,770,858 | 9/1988 | Collins | 422/186 |
| 4,776,071 | 10/1988 | Yoshizawa | 29/130 |
| 4,940,894 | 7/1990 | Morters | 250/324 |
| 5,048,168 | 9/1991 | Vanaschen et al. | 29/123 |

*Primary Examiner*—W. Gary Jones
*Assistant Examiner*—Charles K. Friedman
*Attorney, Agent, or Firm*—Quarles & Brady

[57] ABSTRACT

A dielectric roller for a corona treatment system consists of a self-supporting tubular body of a dielectric material having a conductive layer bonded on its inner wall and a pair of end plugs with hubs closing the ends of the body. At least one of the end plugs is of conductive material and makes electrical contact with the conductive layer so that the roller can be grounded.

5 Claims, 1 Drawing Sheet

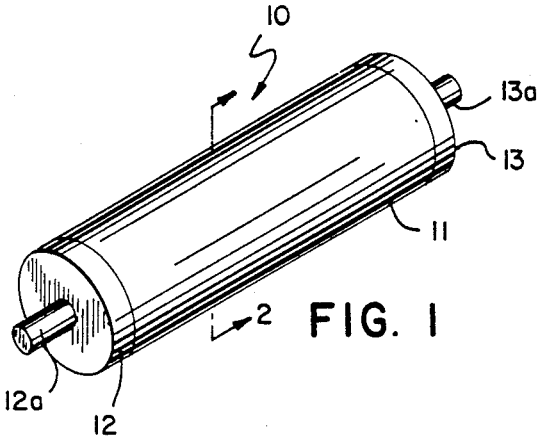
FIG. 1
FIG. 2
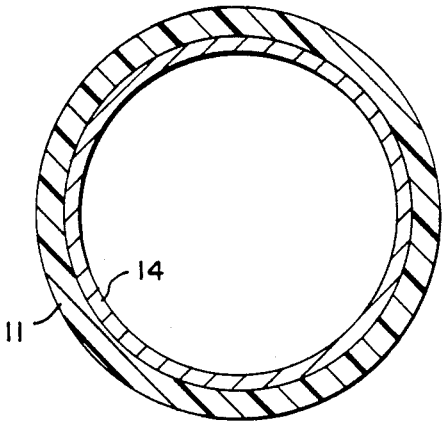
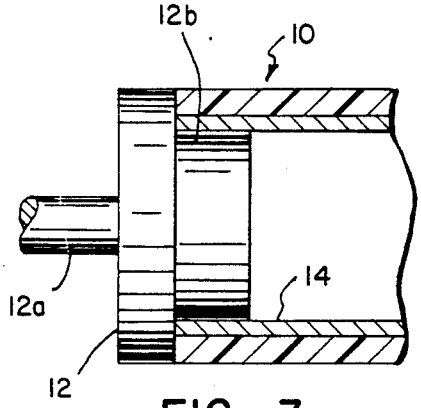
FIG. 3
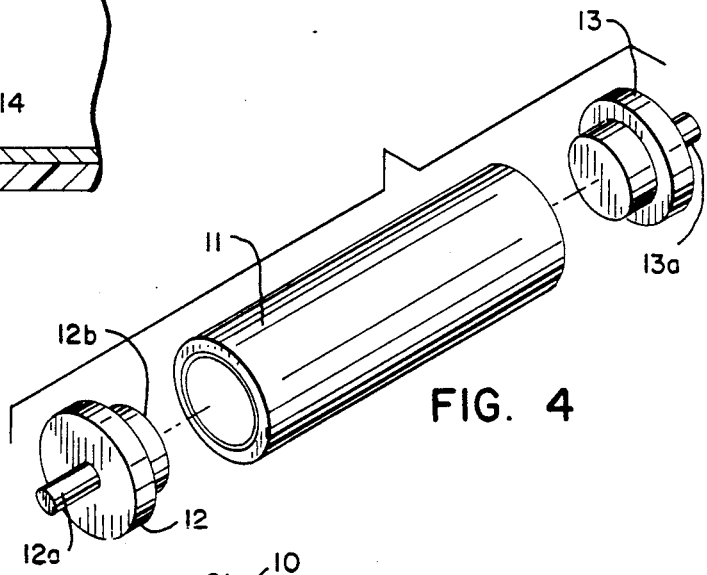
FIG. 4
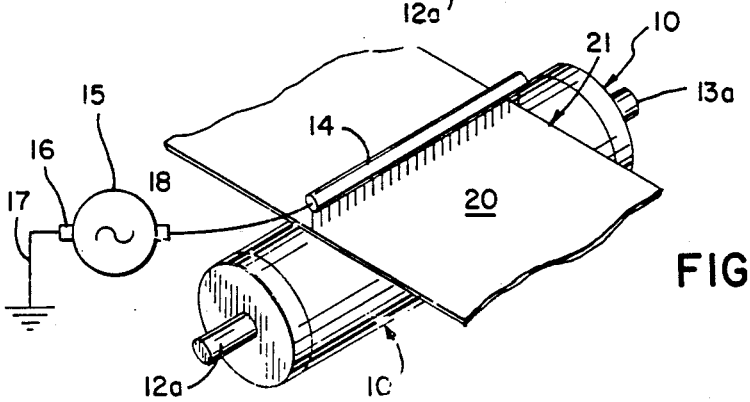
FIG. 5

CORONA TREATMENT ROLLER ELECTRODE

FIELD OF THE INVENTION

The present invention relates to corona treatment. More particularly, it relates to an improved roller for use as a grounded electrode in a corona treatment system.

BACKGROUND OF THE INVENTION

Corona treatment is a method using an electrical corona discharge to modify a plastic surface to improve its ability to accept inks and adhesives. In corona treatment a high voltage electrode is mounted parallel to and spaced from a grounded electrode. The air gap between the electrodes is energized, forming a corona, which, when plastic material is passed through modifies the plastic material and makes it more receptive to ink and adhesives.

In a corona treatment system, a dielectric material is usually applied to at least one of the electrodes to create a high voltage capacitor which helps produce the electrical corona discharge.

In early corona treating systems, the dielectric, usually a piece of the material to be treated, was wrapped around the grounded roller electrode. Due to the porosity of the films and the inability to eliminate air between the wrapped layers, the dielectric frequently pinholed. Although this process enabled quick repair, the amount of downtime due to pinholes was usually too often.

In an effort to improve dielectric life, roller covering suppliers began offering dielectric materials which they would apply and bond directly to the grounded electrode roller. These dielectrics would include such materials as hypalon, silicone, EPDM, epoxy, unsaturated polyesters, glass and ceramic, all of which would be applied directly to the metal ground roller core. Of course, each of these materials offered different physical and electrical properties, which provided the user with advantages and disadvantages, which were unique to the specific material. These advantages would include such things as low cost, longer life, high dielectric strength, better resistance to knife cuts, etc.

A user, by employing one of these dielectrics, would be required to send the metal ground roll core to the roller covering supplier each time the dielectric needed to be replaced, so that the supplier would be able to remove the old covering and recover the core with the new material. In order to be able to do this the user would typically find it necessary to possess an inventory of metal roller cores, since the recovering process could take several weeks to do. Depending on the number of treater systems possessed, the standard delivery times provided by the roller covering supplier and the average life expectancy of the dielectric, the required metal core inventory necessary, could be quite large and costly to maintain.

Adding to the costs associated with the metal core inventory was the need to repair the metal core occasionally. During the process of removing the old covering from the metal core, the roller covering supplier removes a thin layer of the base metal as well. When this occurs, the physical dimensions of the metal core are then changed, which may have an effect on performance. By changing the shape of the core, the dielectric covering wall thickness may vary, which could result in variations in treat levels, premature dielectric failure, etc. In many cases, because the roll is an idlingroll (not driven) the metal core is made of a thin metal material (usually aluminum). Removal of metal from the core surface will eventually weaken the core making it unusable, so that replacements are often required.

Another problem faced by the user is, depending on where the treater is located, the accessibility of the roll. In many cases, the treater station is positioned in locations that make roll changes difficult and time consuming, causing extended periods of downtime and lost production. In an effort to overcome this, several companies offered disposable dielectric coverings, that were designed to slide on top of a metal core. The most common sleeve coverings were rubber, such as silicone and hypalon. However, several companies did offer a fiberglass sleeve which was designed to be used on top of the metal core.

Both the rubber and the epoxy/fiberglass sleeves required a metal roller core which the dielectric would be mounted on. In the case of the rubber sleeves, the metal core diameter was designed to be just slightly larger than the sleeve, so that the sleeve would fit snugly on the mandrel (metal core), thus preventing any additional air gaps between the dielectric and the grounded metal core. Since the sleeves were snug, mounting them to the mandrel required the use of pressurized air to help float the sleeve on. Since the rubber sleeves do not exhibit great resistance to tearing and cuts, they frequently were damaged during the mounting process.

The epoxy/glass sleeves, because they were not elastic, were designed to be slightly larger in diameter than the metal core so that they could easily slide over the mandrel. Once on the mandrel, the epoxy/glass sleeve was pinned to the core. As a result, an air gap would exist between the metal mandrel and the epoxy/glass sleeve. This resulted in a corona being produced in this gap, taking away some of the power that was intended for use on the plastic film. In addition to reducing the efficiency of the system, the undesired corona provided additional stresses on the dielectric that would typically result in premature failures.

There is a need for an inexpensive, disposable roller electrode for use in corona discharge treatment systems.

SUMMARY OF THE INVENTION

It is an object of the present invention to disclose an inexpensive, disposable roller electrode.

It also is an object to disclose a method of making such a roller electrode.

The roller electrode of the present invention comprises a sturdy, self-supporting tube of a dielectric material, such as a glass reinforced epoxy or polyester, having an electrically conductive layer bonded to the inner wall of the tube. By being self-supporting, the dielectric tube eliminates the need for a metal core. In place, all that is needed is removable end plugs which are fitted into the ends of the tube to complete the roller and allow for mounting of the dielectric roller onto the treater station, as well as providing a sufficient path for grounding. At least one of the end plugs is of a conductive material such as metal, ceramic or electrically conductive thermoset materials.

This type of an approach enables the user to eliminate the need for an inventory of metal cores, as well as the costs associated with maintaining these cores. In addition, the user can now replace the dielectric in plant.

Unlike bonded coverings, replacing the dielectric using this invention would take minutes instead of weeks.

Although current sleeve systems are faster to replace than bonded dielectrics, this invention does not require an interference fit with the fixture, so that the change can be made quicker and without the assistance of air or any other aid. Since there is no air gap between the dielectric and the electrically conductive ground layer, there would be no unwanted coronas or power losses generated which could reduce treatment or dielectric life.

Another major benefit of the roller electrode of this invention is due to the weight reduction of the material. By eliminating the core, the lighter material makes it much easier to transport around the plant. Workers who normally would have to carry metal cores, covered with the dielectric, to the treater stations, which were often inconvenient to get to, would now only have to carry the dielectric material, which weighs about 75% less than an equally sized metal core, without any dielectric covering. Thus, dielectric covering changes become easier and most probably require less people.

The weight reduction achieved with the present invention is also a benefit during use, since most of the ground rollers are idler rolls. This reduction in weight enables the roll to turn more freely, allowing for sufficient cooling of the dielectric.

The roller electrode of the present invention is inexpensive and disposable thereby eliminating the need for maintaining or inventorying costly metal roller electrodes.

BRIEF DESCRIPTION OF THE DRAWINGS

In the Drawings:

FIG. 1 is a perspective view of a roller electrode of the present invention;

FIG. 2 is a view taken along lines 2—2 of FIG. 1;

FIG. 3 is a view partly in section taken along lines 3—3 in FIG. 1;

FIG. 4 is an exploded view showing the components of the roller electrode of FIG. 1 aligned prior to assembly; and FIG. 5 is a schematic view showing the roller electrode of FIG. 1 in a typical corona treatment system.

PREFERRED EMBODIMENT OF THE INVENTION

In the preferred embodiment of the invention seen in FIGS. 1 to 4, the roller electrode 10 is seen to comprise a rigid body 11 closed at one end by an end plug 12 having a hub 12*a* and at the other end by an end plug 13 having a hub 13*a*. In FIG. 4, the various components of the roller electrode 10 are seen prior to assembly.

The body 11 of the electrode 10 is a self-supporting tube of a rigid dielectric material, preferably a glass fiber reinforced epoxy or a glass fiber reinforced polymeric polyester. As seen best in FIG. 2, a conductive layer 14 is bonded to the inner wall of the body 11. The conductive layer 14 is a relatively thin conductive metallic film or a coating containing a conductor, such as graphite. The conductive layer 14 is relatively thin and does not have to be self-supporting because it is supported by the inner wall of the body 11. The conductive layer 14 can be bonded to the inner wall by any appropriate method, such as electroplating or spraying.

In FIG. 3 it can be seen that the inner end 12*b* of end plug 12, which is of a conductive material such as metal, ceramic or conductive plastic, electrically contacts the conductive layer 14 so that the roller electrode 10 can be grounded via the hub as shown in FIG. 5. The other end plug 13 fits into the other end of the body 11 in a similar manner. The end plug 13 also can be of a conductive material, but it does not have to be if the roller electrode 10 is grounded by the end plug 12.

The roller electrode 10 of the present invention uses the rigid, inexpensive dielectric tube 11 in place of the conventional metal base and thus makes possible an inexpensive corona roller electrode that can be disposable.

In FIG. 5, a corona treatment system is shown utilizing the roller electrode 10 of the present invention. As seen therein, the corona treatment system includes a high voltage, high frequency power supply 15 that has an output terminal 16 connected to a ground return 17, and a second outlet terminal 18 connected to a high voltage electrode 19 that is mounted parallel to and spaced from the grounded roller electrode 10. The grounded roller electrode 10 supports a web of plastic material 20 which is treated as it passes through the air gap 21 between the grounded roller electrode 10 and the high voltage electrode 19. The air gap 21 between the two electrodes is normally about one sixteenth inch wide and a corona discharge develops in the gap when the high voltage electrode is energized by the power supply. The surface of plastic material 20 passing through the air gap is modified by the exposure to the corona so that its printing properties are improved.

It will be apparent to those skilled in the art the number of changes and modifications that can be made without departing from the spirit and scope of the present invention. Therefore, it is intended that the invention not be limited except by the claims which follow.

We claim:

1. A coreless, dielectric roller for a corona treatment system, said roller consisting essentially of a self-supporting, tubular body of a polymeric dielectric material having a continuous, conductive layer bonded to its inner wall without any air gap therebetween, and a pair of end plugs closing the open ends of the tubular body to form a roller, at least one of said end plugs being conductive and electrically contacting the conductive layer so that the roller can be grounded via the end plug.

2. A roller of claim 1 in which both end plugs are conductive.

3. A roller of claim 1 in which the conductive layer is metallic.

4. A roller of claim 1 in which the conductive layer is of a conductive plastic.

5. A roller of claim 1 in which the tubular body is glass fiber reinforced.

* * * * *